US005808217A

United States Patent [19]

Liao

[11] Patent Number: 5,808,217

[45] Date of Patent: Sep. 15, 1998

[54] SUPERIOR CYMBAL MOUNTING STRUCTURE

[75] Inventor: Tusn-Chi Liao, Taichung, Taiwan

[73] Assignee: Hwa Shin Musical Instrument Co., Ltd., Taichung, Taiwan

[21] Appl. No.: 760,368

[22] Filed: Dec. 4, 1996

[51] Int. Cl.[6] ..... G10D 13/02

[52] U.S. Cl. ..... 84/422.3; 248/121; 248/230.6

[58] Field of Search ..... 84/422.3, 402, 84/453, 421; 248/121, 230.6, 125

[56] References Cited

U.S. PATENT DOCUMENTS 5,388,495 2/1995 Atsumi ..... 84/422.3

5,482,235 1/1996 Atsumi ..... 84/422.3

*Primary Examiner*—Cassandra C. Spyrou

*Attorney, Agent, or Firm*—Bacon & Thomas

[57] ABSTRACT

A superior cymbal mounting structure including a tubular screw member fixed to a center pull rod of a cymbal stand by a screw bolt and a wing nut, a lock nut threaded onto the tubular screw member to fix a superior cymbal to the tubular screw member between two sponge packing rings, wherein a packing block is mounted in a chamber in the lock nut and stopped against the periphery of the tubular screw member by a tightening up screw to fix the lock nut and the tubular screw member together.

1 Claim, 6 Drawing Sheets

SUPERIOR CYMBAL MOUNTING STRUCTURE

BACKGROUND OF THE INVENTION

The present invention relates to a cymbal mounting structure which fixes a superior cymbal to a center pull rod of a cymbal stand, permitting the superior cymbal to be positively moved with the center pull rod to strike a fixed interior cymbal in producing a clashing sound.

A regular high-hat (Charleston) cymbal, as shown in FIG. 1, is generally comprised of an interior cymbal fixedly secured to a cymbal stand, and a superior cymbal fixedly secured to a center pull rod, which is coupled to a pedal. When the pedal is depressed, the superior cymbal is pulled downwards to strike the interior cymbal in producing a clashing sound. The superior cymbal mounting structure, as shown in FIGS. 2 and 3, comprises a tubular screw member sleeved onto the center pull rod of the cymbal stand, a tightening up screw threaded into a transverse screw hole in the tubular screw member to fix the tubular screw member to the center pull rod, a screw nut and a lock nut respectively threaded onto the tubular screw member to fix the superior cymbal around the tubular screw member between two sponge packing rings, which are retained between the screw nut and the lock nut. This superior cymbal mounting structure has drawbacks. When the superior cymbal is continuously moved up and down to strike with the interior cymbal, the tightening up screw and the lock nut tend to be forced to displace. If the tightening up screw is loosened, the center pull rod will not be positively moved with the pedal. If the lock nut is loosened, the superior cymbal will oscillate relative to the center pull rod, and noises will be produced when the superior cymbal and the interior cymbal are struck together.

SUMMARY OF THE INVENTION

The present invention has been accomplished to provide a superior cymbal mounting structure which eliminates the aforesaid problems. According to the preferred embodiment of the present invention, the lock nut which is threaded onto the tubular screw member to fix the superior cymbal around the tubular screw member between two sponge packing rings, has a packing chamber and an oblique screw hole extended from the packing chamber to the outside. A packing block is mounted in the packing chamber of the lock nut and stopped against the periphery of the tubular screw member by a tightening up screw to fix the lock nut and the tubular screw member together. The tightening up screw is threaded into the oblique screw hole of the lock nut and stopped at a bevel bottom edge of the packing block against the tubular screw member.

DETAILED DESCRIPTION OF THE PREFERRED EMBODIMENT

Figure 1:
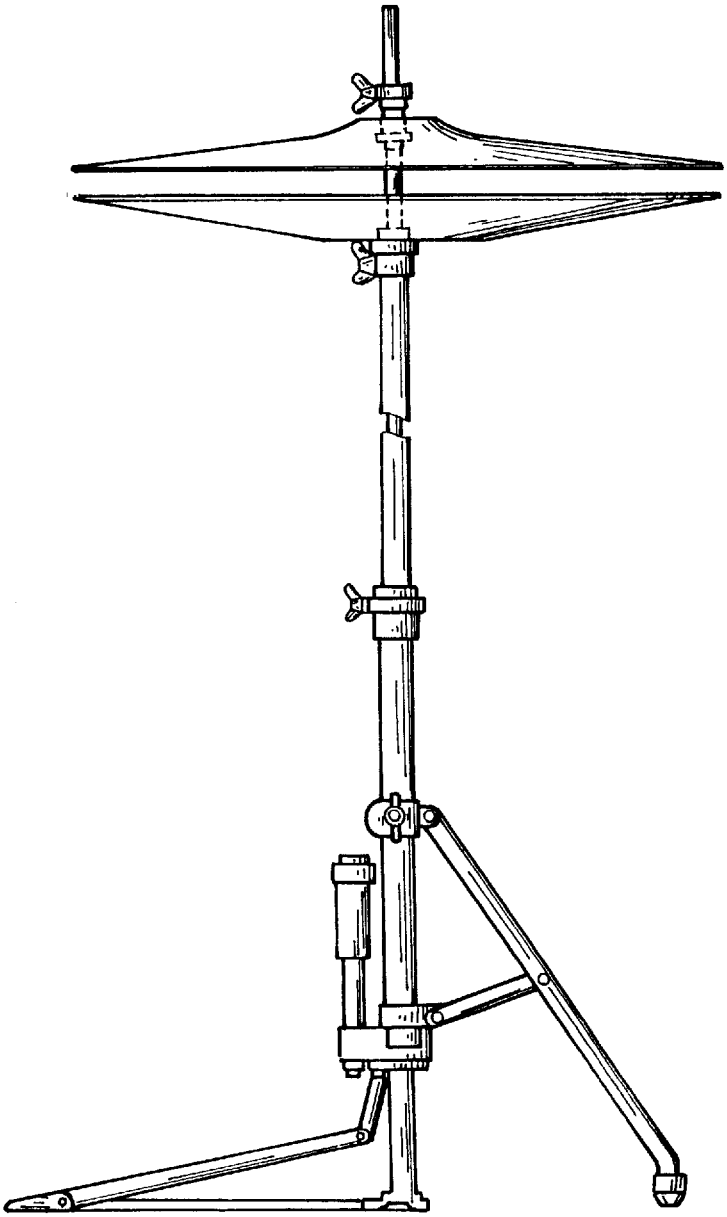
Fig. 1 PRIOR ART
FIG. 1 is an elevational view of a regular high-hat (Charleston) cymbal.
Figure 2:
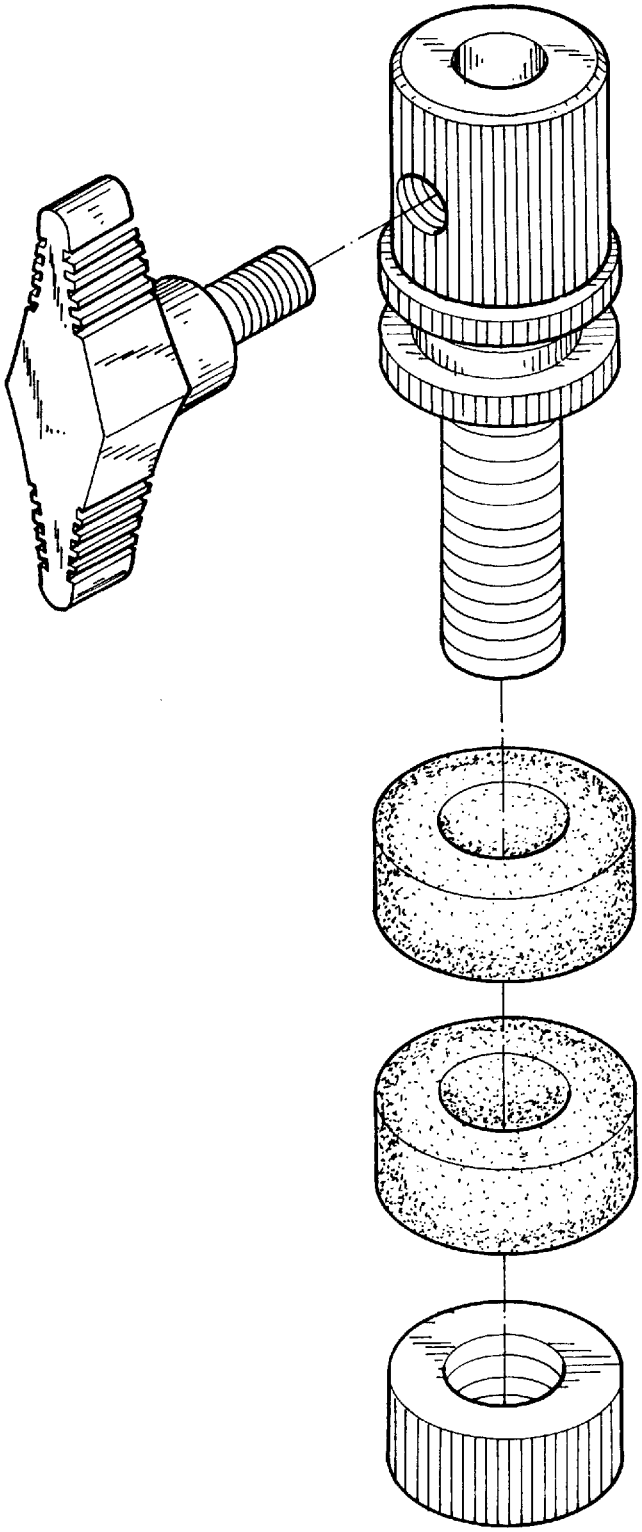
Fig. 2 PRIOR ART
FIG. 2 is an exploded view of a superior cymbal mounting device according to the prior art.
Figure 3:
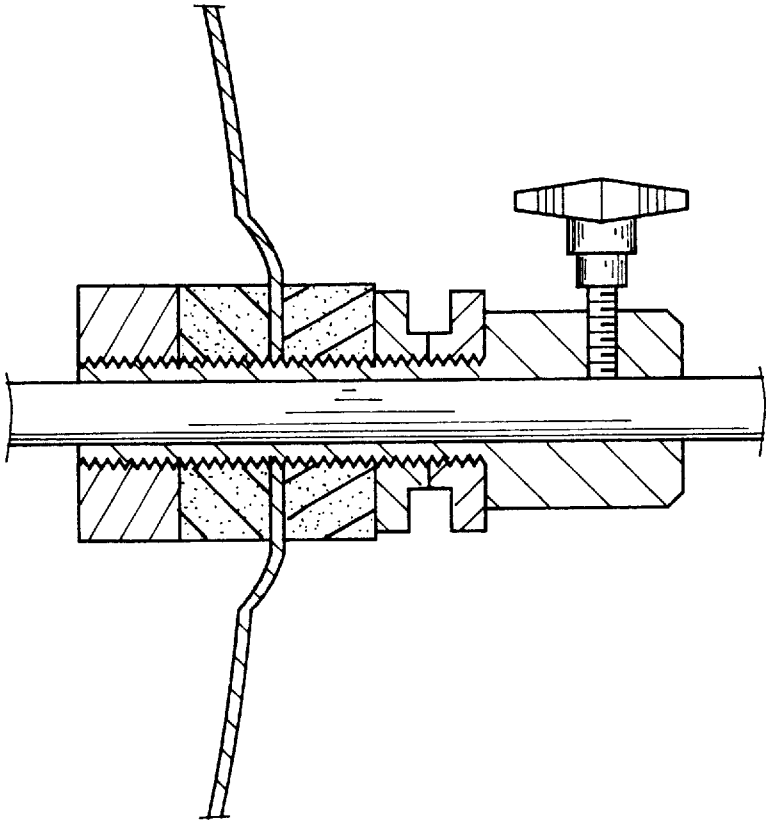
Fig. 3 PRIOR ART
FIG. 3 is an installed view in section of the superior cymbal mounting device shown in FIG. 2.
Figure 4:
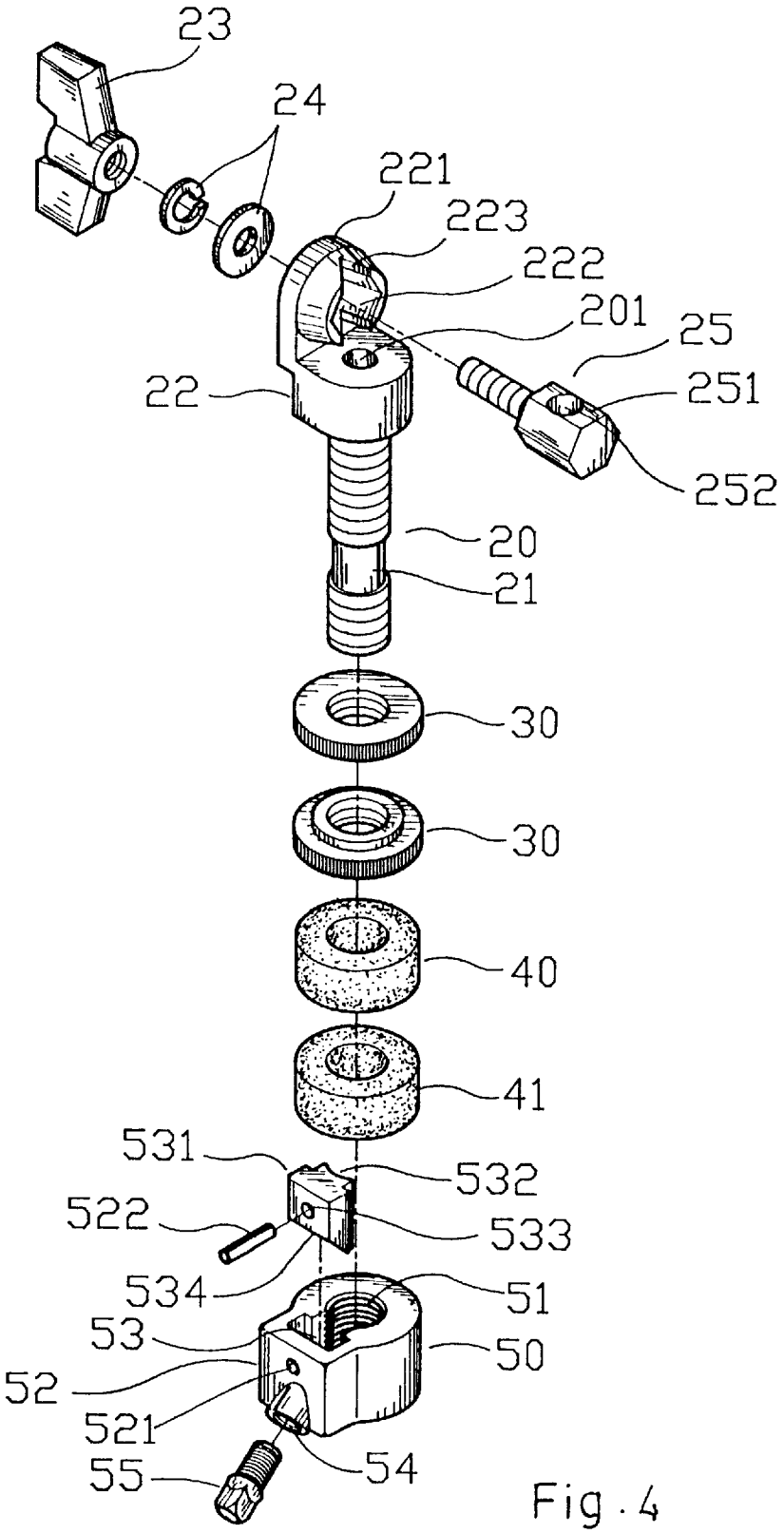
FIG. 4 is an exploded view of the present invention.

Referring to FIGS. from 4 to 6, the present invention comprises a locating screw member 20. The locating screw member 20 comprises a head 22 at one end, a neck 21 remote from the head 22, a longitudinal through hole 201 through the center of the head 22, an upright block 221 raised from the head 22 at right angles, a transverse through hole 222 through the center of the upright block 221, and a plurality of notches 223 formed in the upright block 221 at an inner side around the transverse through hole 222. A screw bolt 25 is inserted through the transverse through hole 222 of the upright block 221 and then screwed up with a wing nut 23, having a head 251 at one end and a transverse through hole 252 through the head 251. Washers 24 are mounted around the screw bolt 25 and retained between the upright block 221 and the wing nut 23. A plurality of screw nuts 30 are threaded onto the locating screw member 20, and closely attached to the head 22. A lock lock member 50 is threaded onto the locating screw member 20 at the bottom. A first sponge packing ring 40 and a second sponge packing ring 41 are respectively mounted around the locating screw member 20, and retained between the head 22 of the locating screw member 20 and the lock member 50, wherein the second sponge packing ring 41 is disposed at the neck 21. The lock member 50 comprises a longitudinal screw hole 51 threaded onto the locating screw member 20, a projecting block 52 raised from one side, a packing chamber 53 defined within the projecting block 52 in communication with the screw hole 51, a transverse pin hole 52 at the projecting block 52 in communication with the packing chamber 53, an oblique screw hole 54 extended obliquely downward from the packing chamber 53 through the projecting block 52 to the outside below the transverse pin hole 521. A packing block 531 is mounted in the packing chamber 53, having a pin hole 533 connected to the transverse pin hole 521 of the projecting block 52 by a pin 522, a smoothly curved packing face 532 facing the longitudinal screw hole 51 of the lock member 50, and a bevel bottom edge 534. A tightening up screw 55 is threaded into the oblique screw hole 54, and stopped against the bevel bottom edge 534 of the packing block 531.

Figure 5:
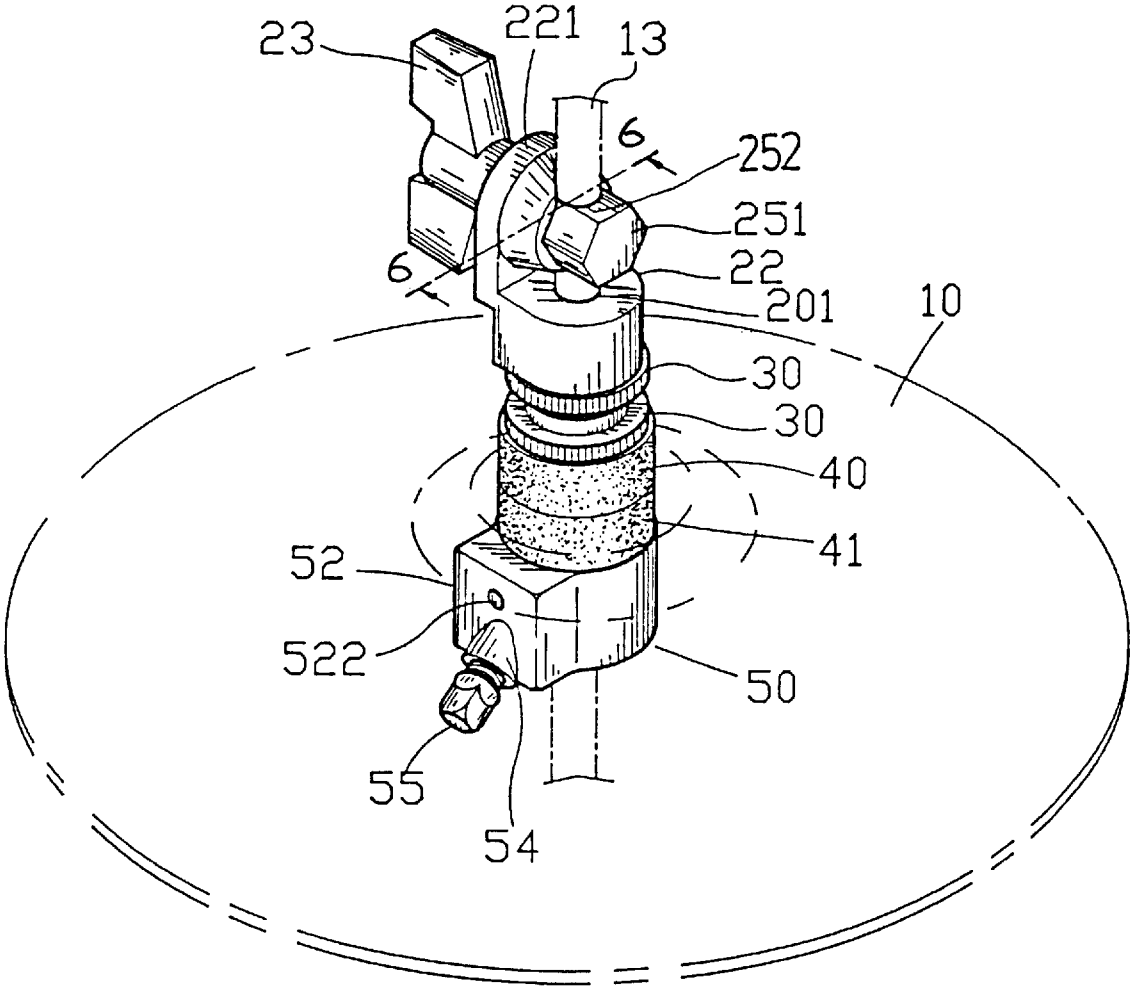
FIG. 5 is an assembly of the present invention.
Figure 6:
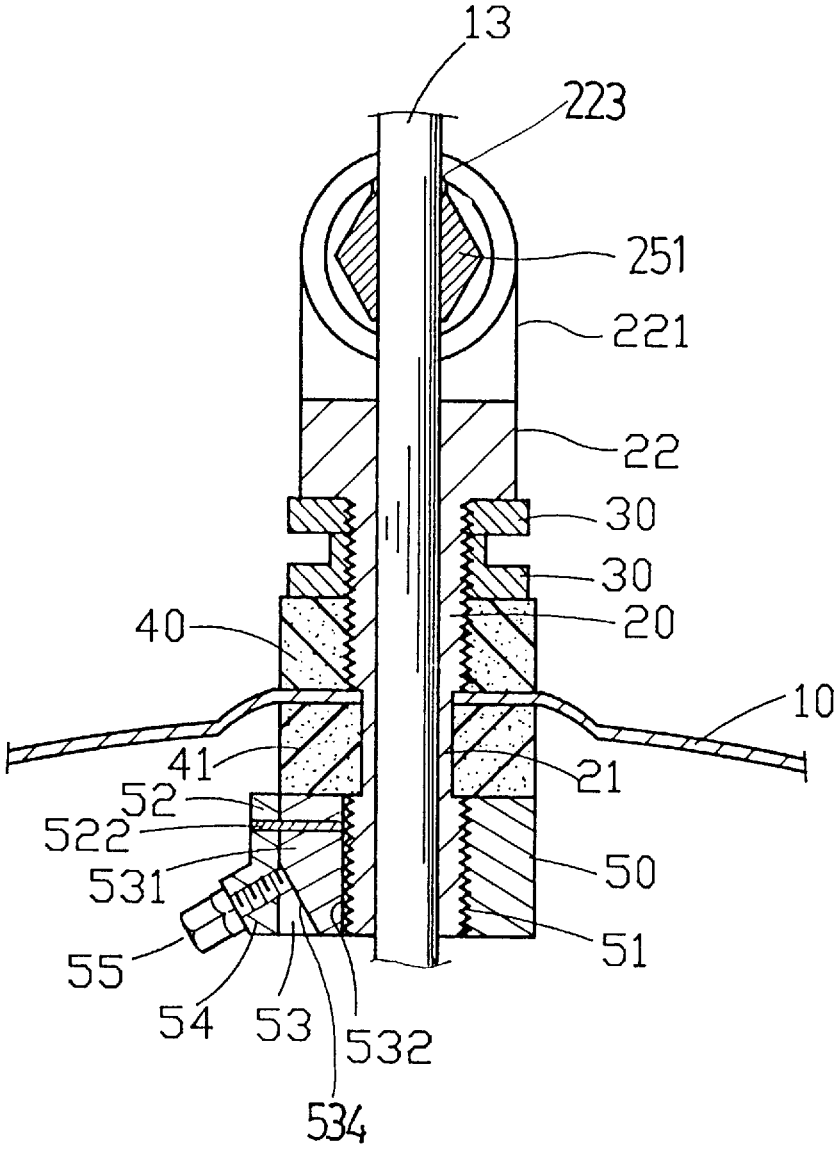
FIG. 6 is a sectional view taken along line A—A of FIG. 5.

Referring to FIGS. 5 and 6 again, the center pull rod 13 of the cymbal stand is inserted through the longitudinal through hole 201 of the locating screw member 20 and the transverse through hole 252 of the head 251 of the screw bolt 25, then the screw nut 23 is turned forwards to pull the screw bolt 25 toward the upright block 221 of the locating screw member 20, thereby causing the center pull rod 13 to be forced sideways into contact with the notches 223 of the upright block 221, and therefore the locating screw member 20 and the center pull rod 13 are fixed together. The superior cymbal 10 is mounted around the locating screw member 20 and retained between the first sponge packing ring 40 and the second sponge packing ring 41. The elevation of the cymbal 10 can be changed by adjusting the position of the screw nuts 30 and the lock nut 50. When the elevation of the lock nut 50 is adjusted, the tightening up screw 55 is screwed tight to hold down the packing block 531, thereby causing the packing face 532 of the packing block 531 to be firmly retained in engagement with the periphery of the locating screw member 20. When installed, the superior cymbal 10 can be positively moved with the center pull rod 13 to strike the interior cymbal (not shown), and to make a clashing sound. Because the superior cymbal 10 is firmly fixed in place by by lock nut 50, it does not oscillate relative to the locating screw member 20 when struck with the interior cymbal.

I claim:

1. A superior cymbal mounting structure comprising:

a tubular locating screw member sleeved onto a center pull rod of a cymbal stand, having a head and an upright block raised from the head, said upright block having a transverse through hole;

a screw bolt inserted through the transverse through hole of the upright block of said tubular locating screw member, having a transverse through hole at one end through which said center pull rod passes;

a wing nut threaded onto said screw bolt to fix said center pull rod and said tubular screw member and said screw bolt together;

a plurality of screw nuts respectively threaded onto said tubular screw member;

a lock nut threaded onto said tubular screw member;

two sponge packing rings respectively mounted around said tubular screw member and retained between said screw nuts and said lock nut; and a superior cymbal mounted around said center pull rod, fixed between said sponge packing rings, and moved with said center pull ring to strike a fixed interior cymbal in producing a clashing sound;

wherein said lock nut comprises a projecting block raised from one side, a packing chamber defined within said projecting block, and an oblique screw hole;

a packing block is mounted within the packing chamber of said lock nut, having a smoothly curved packing face disposed in contact with the periphery of said tubular screw member, and a bevel bottom edge;

a tightening up screw is threaded into the oblique screw hole of the projecting block of said lock nut and stopped at the bevel bottom edge of said packing block against said tubular screw member to fix said lock nut and said tubular screw member together.

* * * * *